US006237549B1

(12) United States Patent
Huff

(10) Patent No.: US 6,237,549 B1
(45) Date of Patent: May 29, 2001

(54) VENTED VALVE MECHANISM FOR INTERNAL COMBUSTION ENGINES

(75) Inventor: Reggie D. Huff, St. Helens, OR (US)

(73) Assignee: Acro-Tech, Inc, Scappoose, OR (US)

( * ) Notice: Subject to any disclaimer, the term of this patent is extended or adjusted under 35 U.S.C. 154(b) by 0 days.

(21) Appl. No.: 09/294,906

(22) Filed: Apr. 21, 1999

(51) Int. Cl.[7] ..... F01L 1/28
(52) U.S. Cl. ..... 123/79 C; 123/188.2
(58) Field of Search ..... 123/79 C, 188.7

(56) References Cited

U.S. PATENT DOCUMENTS

| | | | | |
|---|---|---|---|---|
| 2,439,618 | * | 4/1948 | Cloutier | 123/79 C |
| 3,903,855 | * | 9/1975 | Klakulak et al. | 123/79 C |
| 4,450,795 | * | 5/1984 | Schaich | 123/79 C |
| 4,450,796 | * | 5/1984 | Schaich | 123/79 C |
| 4,836,154 | * | 6/1989 | Bergeron | 123/79 C |
| 5,357,914 | * | 10/1994 | Huff | 123/79 C |

* cited by examiner

*Primary Examiner*—Willis R. Wolfe
*Assistant Examiner*—Jason A Benton

(57) ABSTRACT

A two piece intake valve for internal combustion engines comprising an inner and an outer valve which can be designed with orbicular heads. The inner valve including a stem of a smaller outer diameter than the outer valve. The outer valve including a hollow stem large enough to accept the inner valve stem, an inner valve guide, and an inner valve control spring and retainer mechanism. The outer valve also including a valve seat in the center of its bottom face to seat the inner valve. The head, or base, being equipped with one or more vents which communicate between the intake port and the combustion chamber and being releasably opened and sealed off by the inner valve. The vented valve unit incorporating an independent actuation means by way of pressure differentials created by the induction cycle, and/or directional inertia factors of the mechanically controlled valve element. The vented valve unit also incorporating design features to effectively control and dampen inner valve closing.

6 Claims, 7 Drawing Sheets

VENTED VALVE MECHANISM FOR INTERNAL COMBUSTION ENGINES

BACKGROUND

The invention here disclosed relates primarily to a reciprocating intake valve for controlling the movement of air/fuel mixture into the combustion chamber (cylinder) of internal combustion engines.

In typical internal combustion engines the valves that control the flow of atmosphere to and from the combustion chamber are one piece, with one spring retainer, and various spring control arrangements.

Since the efficiency of this valve arrangement is a major factor in the performance of the entire engine, many attempts at maximizing the potential flow dimension of these valves have been explored. Since a homogeneous air/fuel mixture is also an important factor in the performance of internal combustion engines, many attempts to use the one piece valve arrangement in different ways to create a swirl effect have also been explored. Increasing the flow dimension allowed by the intake valve automatically increases the power of the engine. Creating a more homogeneous air/fuel mixture also automatically increases the power of the engine by breaking down the fuel into smaller particles that can be more easily combusted, which, more importantly, increases the fuel efficiency and reduces the environmentally harmful emissions of internal combustion engines.

Since the timing and control of this valve arrangement is also a major factor in the performance of the entire engine, many attempts to maximize valve timing over a broad range of constantly variable conditions, such as load, speed, and atmosphere, have been explored.

It is toward these fundamental factors of improved flow dimension (volume), homogeneous air/fuel charge conditioning, and multi-dimensional, constant variable valve timing, that the here disclosed invention takes a giant step forward, by accomplishing all three at the same time.

It is further the intent of the here disclosed invention(s) to address other important factors revealed through the extensive testing and study of early vented valve designs. Such as the type disclosed in U.S. Pat. No. 5,357,914, issued to Huff. While these early designs integrate two main valve elements in a manner broadly similar to the here disclosed invention, they incorporate a cross pin inner valve retention system. This arrangement complicates the manufacture of the valve units by requiring precise vertical slots to be machined into the stem of the outer valve, and small precise cross drilled holes into the stem of the inner valve.

In addition, these designs require recessed spring landing sections to be machined into the outer valve stems. This arrangement makes installation of the inner valve control spring(s) and subsequently the aforementioned retainer pin (s) cumbersome, making automation of the entire assembly challenging.

It further utilized the hollow outer valve stem as a guide for the inner valve stem. This makes otherwise normal and acceptable outer valve head and stem deflection unacceptable. this can cause inner valve stem binding, which adversely effects its performance and promotes premature wear.

It further utilizes a single inner valve seat on the outer perimeter of the inner valve head. This arrangement can promote independent inner valve head deflection and subsequently inner valve bounce, especially at high speeds.

It further tends to promote over lubrication by communicating an inner valve pocket low pressure signal through the aforementioned pin slots to the outer valve stem seal, pulling excess lubrication past it and into the working mechanism.

It further compromises longevity by not allowing inner valve rotation independent of the outer valve, and making the use of special guide material, such as cast iron, for the inner valve stem impractical.

It further slightly increases the risk over standard valves of sudden outer valve main guide failure due to the possibility of small spring burrs or chips dislodging within the guide and lodging in-between the stem and guide, and damaging both the guide and the valve stem.

Additionally, a minor factor concerning these designs relates to ease of implementation or retrofit. Besides the somewhat larger outer valve stem outside diameter it requires, the inner valve pin and spring arrangement make the design and placement of the outer valve main guide more critical. This also makes universal production between similar applications less feasible.

It is to these fundamental factors effecting the performance, longevity, manufacturability, retrofitability, and cost of vented valves, that the here disclosed invention takes another giant step forward, by accomplishing vast improvements in all areas of concern at the same time, while providing the exceptional bonus of self regulated dampening of the inner valve closing function. Further clarification of the advantages and features of the present invention(s) is provided within the specification.

BRIEF SUMMARY OF INVENTION

This invention relates primarily to engine valving, and, in particular, the reciprocating valves necessary for the intake of air/fuel mixture into the combustion chambers of conventional internal combustion engines, wherein the intake valve head incorporates vents in order to vastly improve the flow dimension allowed during the time constrained operation of the intake valve.

In order to obtain the maximum power output and efficiency of conventional internal combustion engines it is necessary to maximize the flow dimension of the air/fuel mixture and exhaust gases to and from the combustion chamber. The traditionally accepted method used to attempt this is by use of single stage (function) reciprocating intake and exhaust valves, actuated by a cam transferring a predetermined displacement sequence motion to a rocker arm that transfers its motion to the tip of the valve stem, controlling the valve's displacement and timing.

The invention disclosed herein is an intake valve for internal combustion engines that automatically takes in atmosphere in two stages and creates a multi-layered flow path, instead of a conventional single layer flow path, to allow more atmosphere into the combustion chamber, and, in addition, allow for a broader timing range of flow events, thereby maximizing engine performance at all engine speeds.

In the preferred embodiments the intake vented valve is designed with an inner valve and an outer (main) valve. The outer valve is designed with vents in is head portion that communicate between the intake port and the combustion chamber. The vents are releasably sealed off by the inner valve head.

In the preferred embodiment therein the inner valve and the inner valve guide, control spring, and retainer clip are pre-assembled.

The outer valve is designed with a hollow stem sized to allow a secure press fit of the inner valve guide. The two main elements are mated by pressing the entire inner valve mechanism along with the inner valve guide into the hollow outer valve stem, retaining the inner valve and completing the vented valve assembly.

In an alternative embodiment the outer (main) valve is constructed in two major parts. The outer valve head and fillet segment, and the stem segment. The stem segment also includes a hollow portion which runs from the opposite end of the tip end towards the tip end.

The valve head segment is assembled with the inner valve stem protruding through a through bore which runs through the center of the valve head segment and acts as a guide for the inner valve stem. A spring is installed on top of the stem base portion of the valve head segment around the protruding portion of the inner valve stem. The spring and inner valve are retained by a retainer clip arrangement.

The stem segment is pressed onto the stem base of the valve head segment over the inner valve retainer and control spring arrangement encapsulating the inner valve control means within the hollow portion of the stem segment. The stem segment can then be laser or friction welded in place.

In another alternative embodiment the outer valve is designed in a single piece arrangement in a similar fashion to the preferred embodiment above. The inner valve is designed as an annular ring with no stem and a hole in its center. A retainer pin is inserted through the inner valve center hole and then pressed into the outer valve hollow stem. The retainer pin is designed with a head portion to effectively retain the inner disc valve from disengagement. The retainer pin also acts as a guide for the inner valve. The retainer pin is installed to allow free movement of the inner valve and defines its displacement range. The inner valve can be designed to accommodate air chambers which traps air as it moves from the closed to the open position and vice versa to effectively dampen and control its opening and closing motion.

In reference to all of the aforementioned embodiments, the outer valve's actuation and control is dependent upon the direct mechanical application of cam displacement, or hydraulic, pneumatic, or electromagnetic forces. The inner valve's actuation and control is semi-independent of the direct mechanical control of the outer valve. Its low mass require light control spring forces, which can be overcome by pressure differentials between the intake port and the combustion chamber (cylinder) created during the induction cycle, and also allow the inner valve to remain open as the inertia of the outer valve is reversed in the direction of the closed position. These inertia forces increase in relative direct proportion to flow demand. This allows for controlled, instantaneous actuation, sustained opening of the inner valve during the induction cycle, and instantaneous closing during the compression cycle.

The semi-independent control of the inner valve allows the engine to time its actuation with flow demand and its timing, which varies throughout the RPM (Revolutions Per Minute) range. This increases the torque over a broader RPM range. The multi-layered flow path created when both inner and outer valves are open, allowing flow through the vents and around the main seat area of the outer (main) valve, increases flow dimension, which enhances performance. Turbulence past the valve in the combustion chamber is also increased, which reciprocates enhanced fuel efficiency and lowers environmentally harmful emissions.

DETAILED DESCRIPTION OF PREFERRED EMBODIMENTS

As illustrated by FIGS. 1, 2, 3, & 4, the inner and outer valve mechanisms, #11 & #20, are placed into their respective valve guides, #14 & #1. The main valve guide, #1, is part of the overall head of the engine, #5. The valve mechanisms control the flow of atmosphere through an intake port, #4, into the combustion chamber, #3, by opening and closing at times corresponding with various engine cycles. The piston, #6, moves up and down in its cylinder, #8, in a timed sequence with the intake valve mechanisms, #20 & #11, and the exhaust valve mechanism, #9, to push or pull atmosphere to or from the ports, #4 & #7, depending on whether it is on an intake or an exhaust cycle.

As further illustrated by FIGS. 1, 2, 3, & 4, the intake valve is formed of two main members, each a distinct and different valve, but both are required to make up the composite valve assembly. For purposes of easy distinction the central member, FIG. 1-#11, will be referred to as the 'inner valve' member, and FIG. 1-#20 will be refereed to as the 'outer valve' member.

Figure 1:
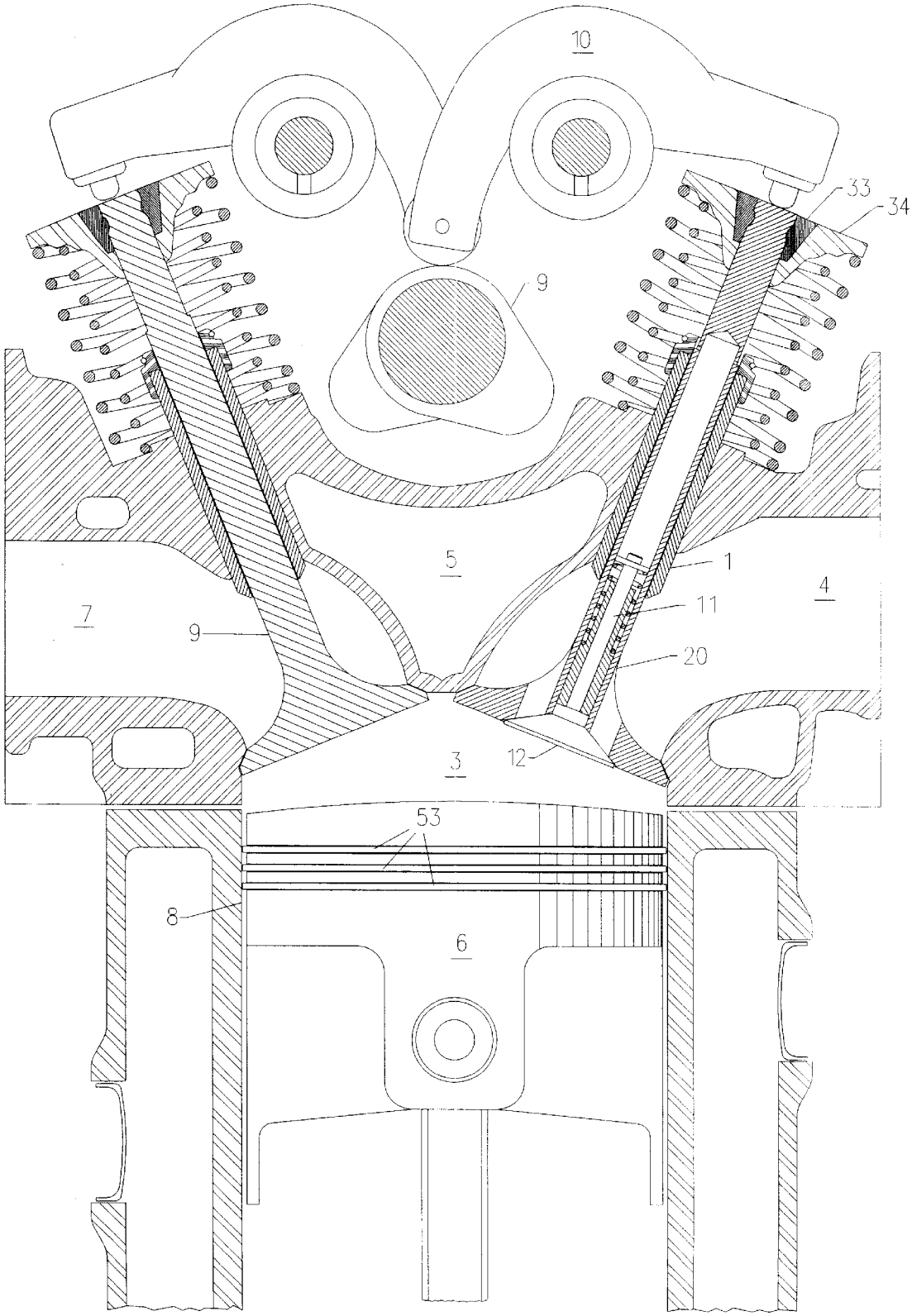
FIG. 1 is a sectional front view of a typical internal combustion engine comprising the vented valve assemblies, illustrating the inner workings and design of the vented chamber, the spring(s), and other various components, in the resting position.
Figure 4:
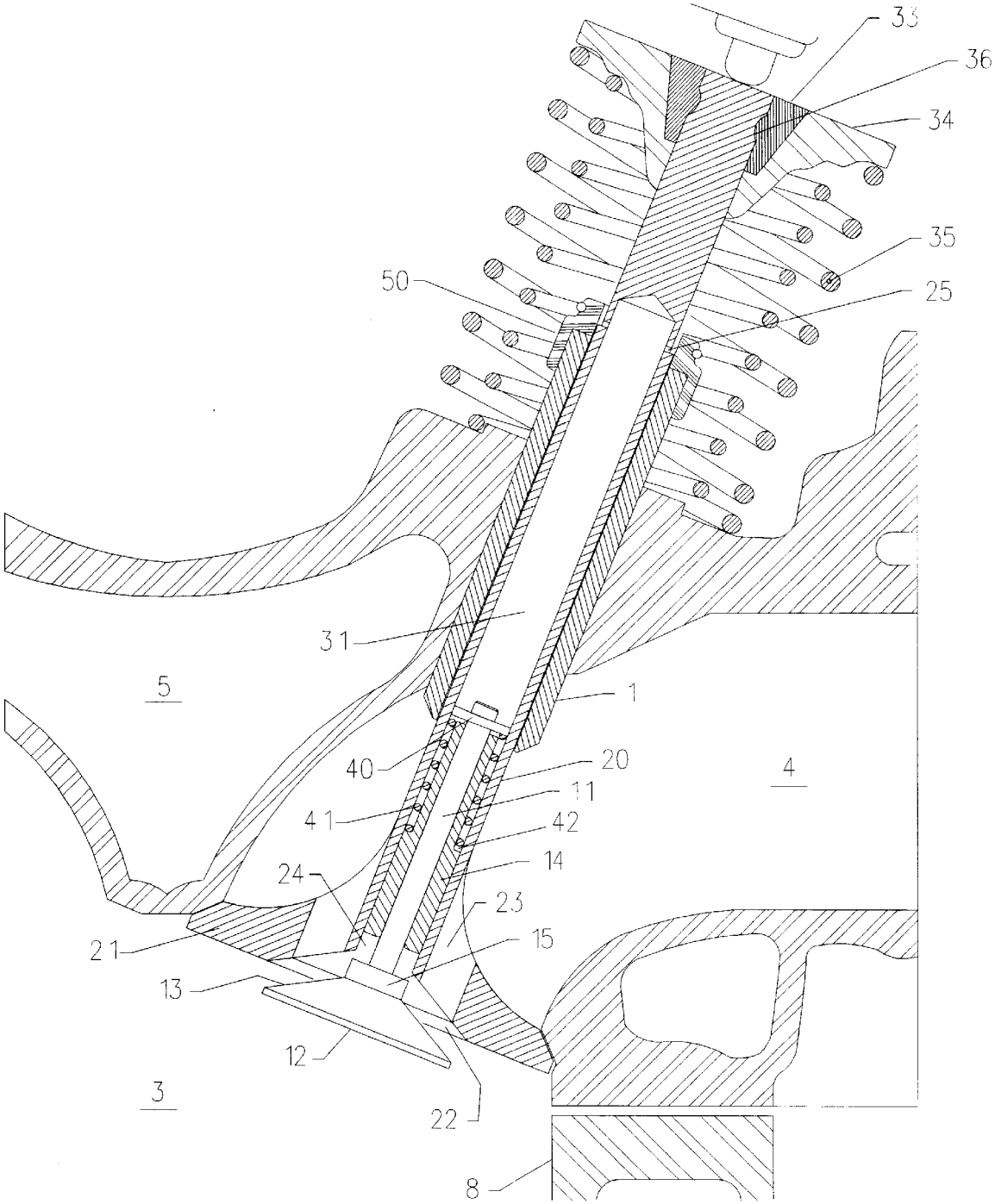
FIG. 4 is an expanded view of an intake vented valve assembly alone.
Figure 5:
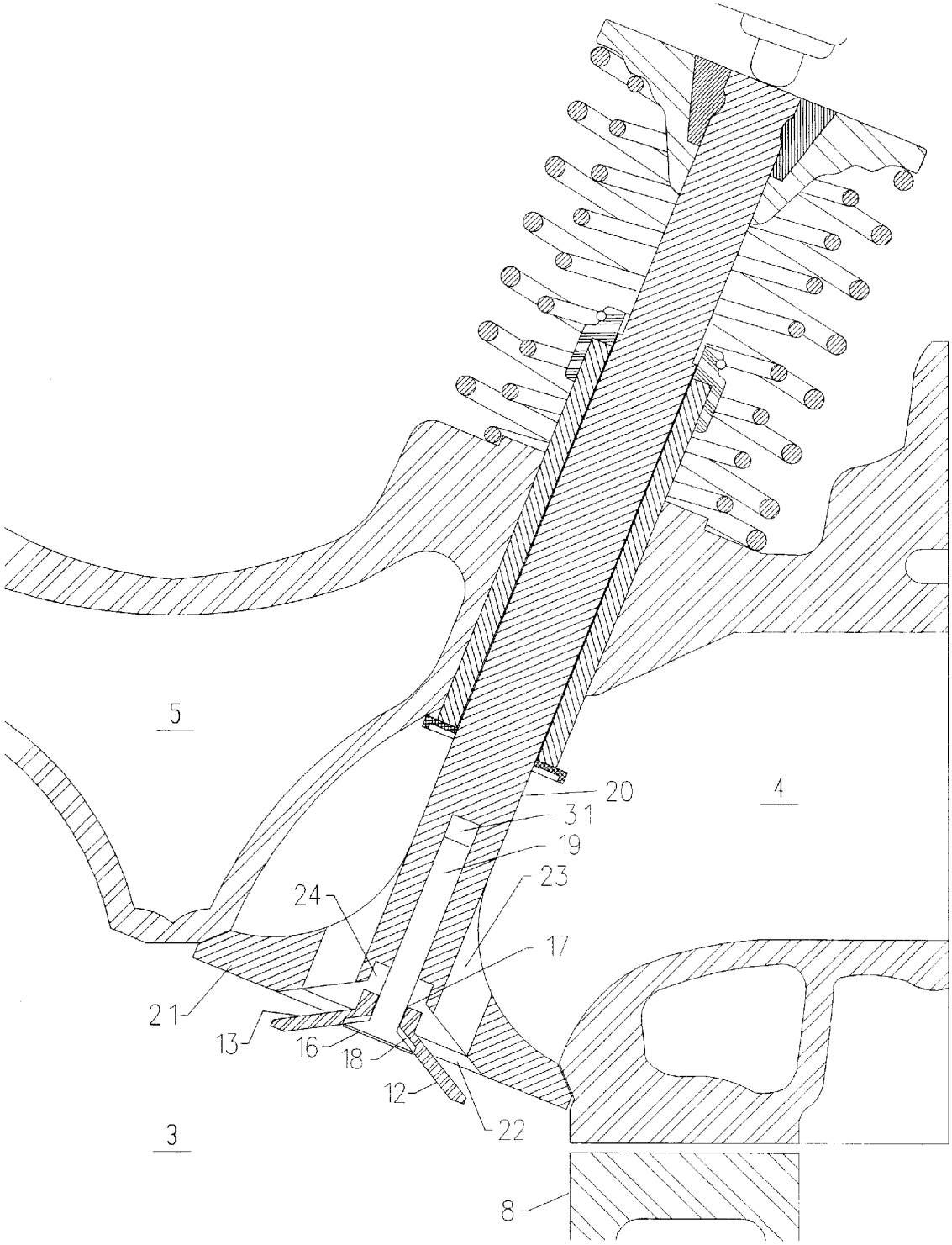
FIG. 5 is an expanded view of an alternative embodiment to the preferred embodiment.
Figure 8:
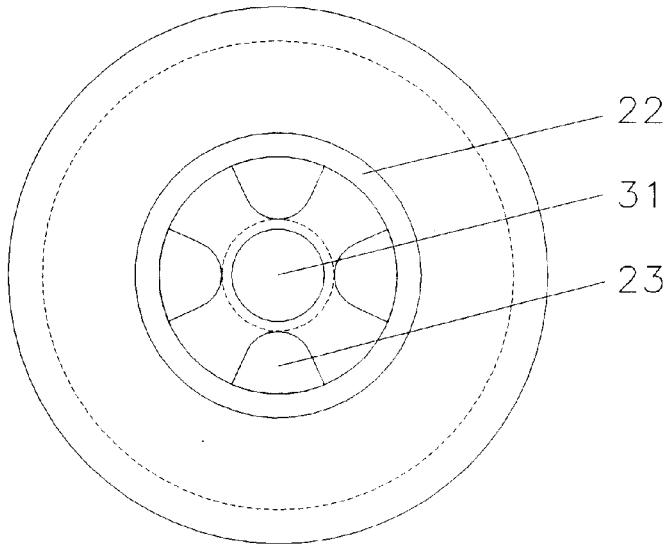
FIG. 8 is an expanded bottom view of an outer valve without the inner valve, to illustrate where the inner valve is placed and the inner passage ways of the outer valve.

As illustrated by FIGS. 4, 5, & 8, the inner valve, FIG. 4-#11, is constructed with a base, FIG. 4-#12, which could incorporate many different traditional internal combustion engine valve designs as to the shape of the base. The base of the inner valve, FIG. 4-#12, is formed with an angle(s) cut throughout the circumference of its side portion, FIG. 4-#13. This angle(s) corresponds with the angle(s) cut into the circumference of the annular seat in the base of the outer valve, FIGS. 4 & 8-#22, so as to form a complete seal when mated in the closed position, as depicted in FIG. 1. The inner valve has a stem, FIG. 4-#11, attached to its base, FIG. 4-#12. The inner valve includes a stepped shoulder, FIG. 4-#15, which acts as a secondary landing or seat for the inner valve base, FIG. 4-#12.

Figure 2:
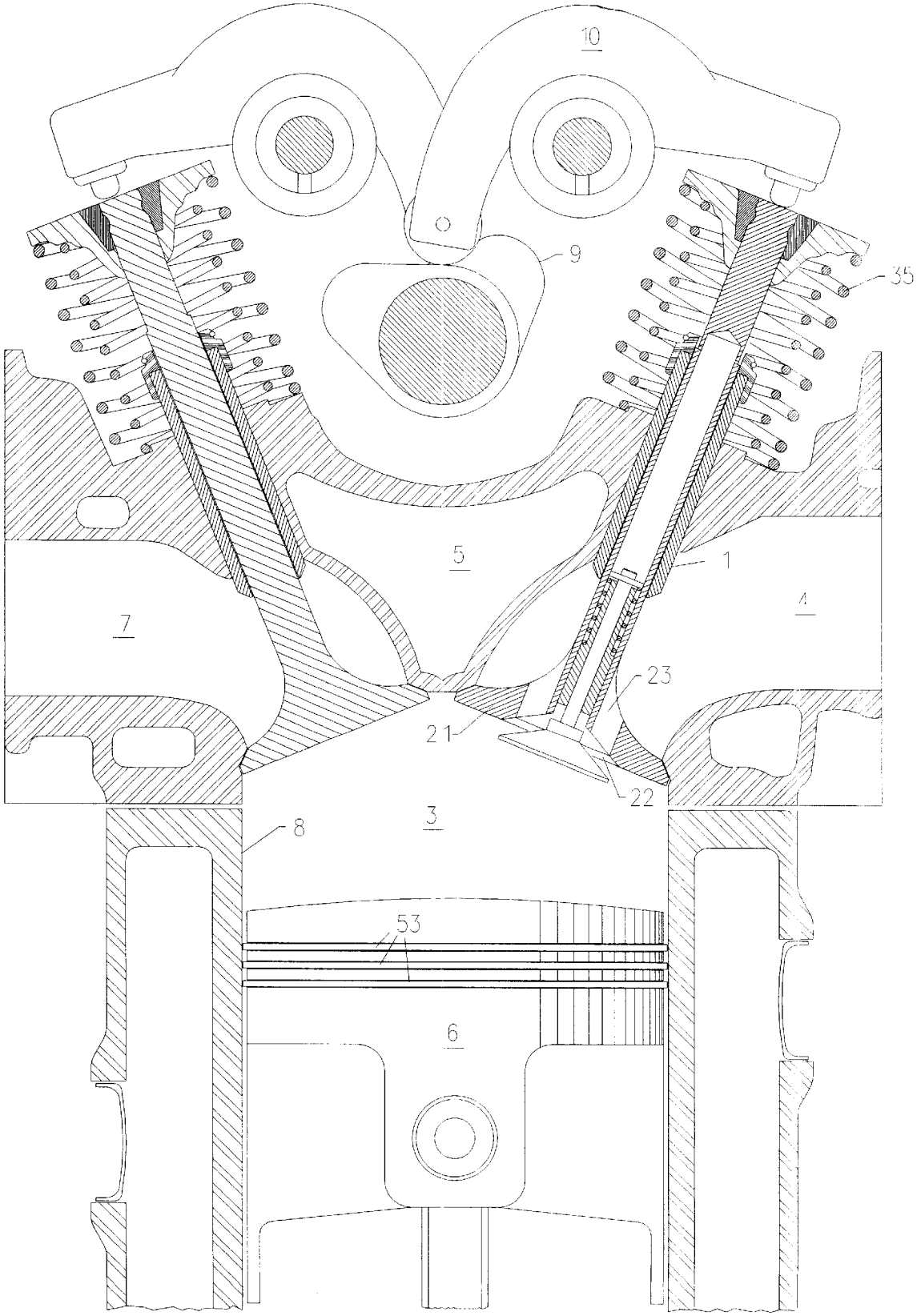
FIG. 2 is a sectional front view of a typical internal combustion engine during the induction cycle comprising the intake vented valve assemblies with the inner valve in the fully open position, and the outer valve in a resting or fully closed position.
Figure 3:
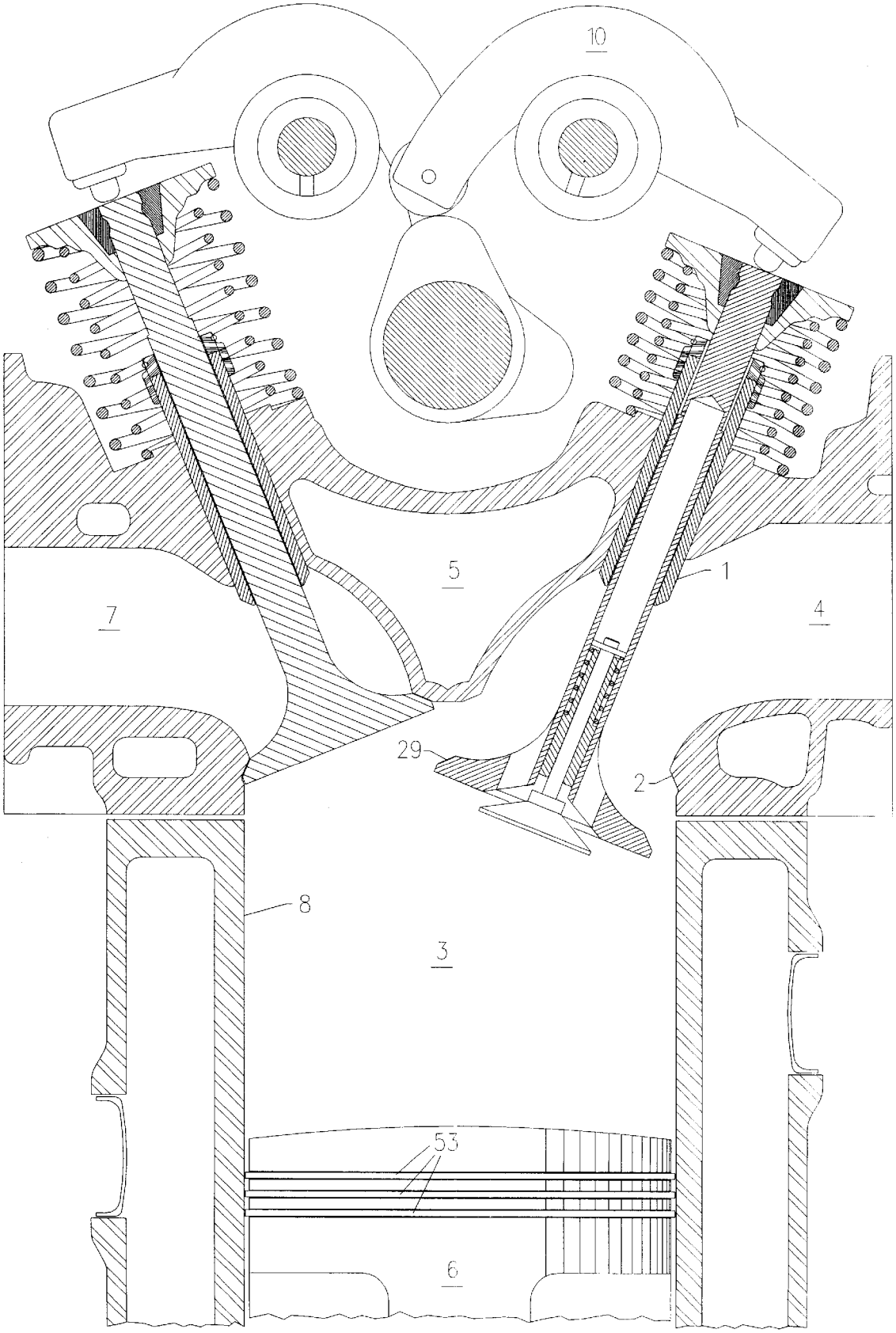
FIG. 3 is a sectional front view of a typical internal combustion engine during the induction cycle, illustrating the intake vented valve assembly with the inner and outer vales I the fully open position and a non-sectional portion of the stem.
Figure 7:
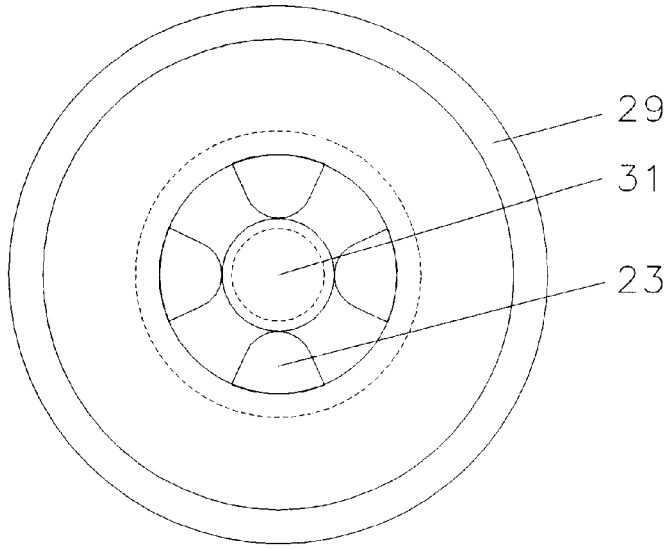
FIG. 7 is an expanded plan view of an outer valve without springs or an inner valve, to illustrate one of the many possible designs for the vents in the outer valve.

As illustrated by FIGS. 2, 3, & 7, the outer valve is constructed with a base, FIG. 2-#21, that could incorporate many different designs as to the shape of the base, and has an angle(s) cut throughout the circumference of the outside edge of the base FIGS. 3 & 7-#29, that corresponds with the angle(s) cut into the circumference of the annular seat area formed at the port edge, FIG. 3-#2.

As illustrated by FIGS. 4, 7, & 8, the outer valve is constructed with a vent(s), FIGS. 4, 7, & 8-#23, on the top, or port side, of the base of the outer valve. This vent(s) allows communication between the port, FIG. 4-#4, and the combustion chamber, FIG. 1, 2, 3, & 4-#3. The outer valve is constructed with a hollow stem portion, FIG. 4 & 8-#31, which runs into, but not through, the outer valve stem.

As illustrated by FIGS. 3 & 4, the outer valve, FIG. 4-#20, has machined grooves formed at the top of the stem, FIG. 4-#36, to accept spring retainer locks, FIG. 4-#33, which lock an annular spring retainer, FIG. 4-#34, at the top of the stem. This is in order to retain the coil spring, FIG. 4-#35, in a predetermined preload position and maintain constant pressure against the outer valve in the direction of the close position until a cam lobe, FIG. 3-#9, transfers its displacement to a rocker arm, FIG. 3-#10, to displace the outer valve in the direction of the open position, as depicted in FIG. 3.

As illustrated by FIGS. 1, 2, 3, & 4, the inner valve stem, FIG. 4-#11, includes an annular retainer, FIG. 4-#40, which can be affixed onto the inner valve stem through various common means such as press fitting or welding. The inner valve stem, FIG. 4-#11, runs into and through the inner valve guide, FIG. 4-#14. The inner valve control spring(s), FIG. 4-#41, in a predetermined preload position, acts upon the inner valve retainer, #40, with constant pressure in the direction of the closed position. The inner valve guide, FIG. 4-#14, also provides a spring base, FIG. 4-#42, for landing the inner valve control spring, FIG. 4-#41. The inner valve, inner valve guide, spring, and retainer are preassembled as a unit. The outside diameter of the inner valve guide, FIG. 4-#14, is sized to interfere slightly with the internal diameter of the hollow portion of the outer valve stem, FIGS. 4 & 8-#31. This allows the entire inner valve control and retention mechanism as a unit to be permanently affixed to the outer valve by pressing the inner valve guide, FIG. 4-#14 into the hollow portion of the outer valve stem, FIGS. 4 & 8-#31, to effectively retain, support, and guide the inner valve member.

As illustrated by FIG. 4, lubricity control is facilitated by an annular oil seal(s), #50. Inner valve lubricity control is facilitated by a small oil hole(s), #25, which communicates between the outer valve guide, #1, and the outer valve hollow stem portion, #31.

In FIG. 5 an alternative embodiment is illustrated wherein the inner valve is constructed in the form of a disc, #12. A retainer pin, #19, is formed with a base, #16, and is inserted loosely through a hole in the center of the disc valve, #17, which runs parallel to its axis. The retainer pin is then press fit into a bore, #31, in the center of the outer valve stem, #20, to simultaneously retain, guide, and control the disc valve, #12.

Figure 6:
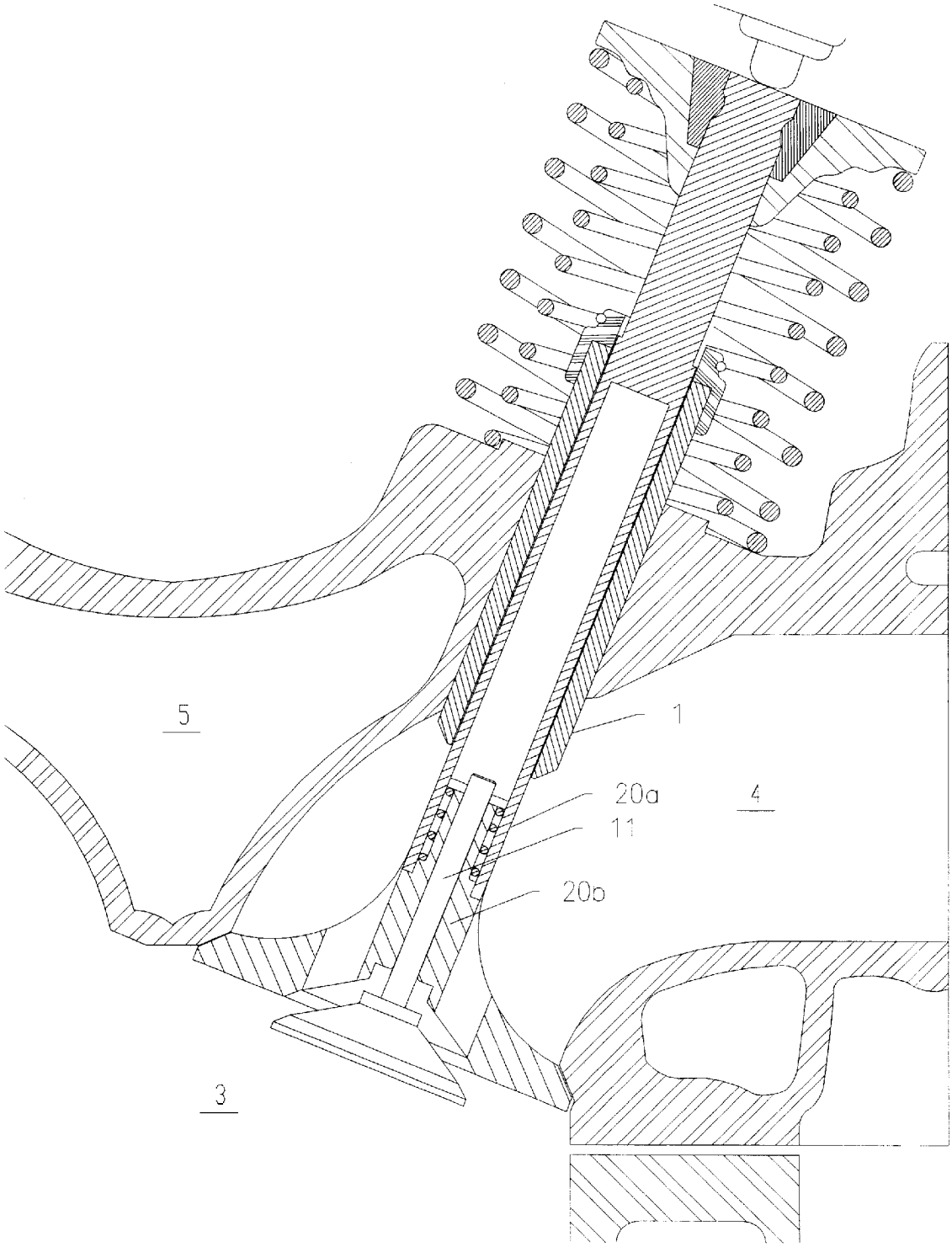
FIG. 6 is an expanded view of an additional alternative embodiment to the preferred embodiment.

In FIG. 6 an additional alternative embodiment is illustrated wherein the outer valve is formed of two main members, an upper hollow stem member, #20A, and a lower base member, #20B. Construction of the entire valve mechanism is completed by mating the two members together, perhaps by laser or friction welding. The lower base member, #20B, also acts as an inner valve guide bearing member to effectively retain, support, and guide an inner valve member, #11, on the outer valve member, #20A, which forms a single outer valve member when mated with #20B.

DETAILED OPERATION OF PREFERRED EMBODIMENTS

As illustrated in FIG. 1, when both the intake and exhaust valve mechanisms are in a resting and fully closed position the intake part, #4, and the exhaust port, #7, are blocked from communication with the combustion chamber, #3, and a complete seal from combustion pressures created by the combustion process is facilitated.

As illustrated by FIG. 4, the inner valve, #11, is diminutive in size and mass, and can be constructed of a titanium material to further reduce its mass. This, in turn, allows the control springs(s), #41, to be small enough to be confined within the hollow portion of the outer valve stem, #31.

As depicted in FIGS. 2, 3, & 4, after the exhaust gases have been scavenged from the combustion chamber and the induction process begins the piston, FIG. 2-#6, begins to move rapidly down the cylinder, FIG. 2-#8, and is sealed against the cylinder by means of multiple rings, FIG. 2-#53. This creates a rapid pressure drop in the combustion chamber, FIG. 2-#3, which at a certain point becomes lower than the pressure in the intake port, FIG. 2-#4. This pressure differential applies force against the port side of the intake valve mechanism. When this force is applied against the head of the inner valve and becomes greater than the force applied against the retainer, FIG. 4-#40, by the inner valve control spring(s), FIG. 4-#41, the inner valve is displaced open independent of the outer valve allowing the flow of atmosphere mixture from the port through the outer valve vent(s), FIG. 2, 4, 7, & 8-#23, into the combustion chamber. The actuation speed, duration, displacement and maximum displacement are determined by the load rate(s) of the inner valve control spring(s).

As depicted in FIG. 4 the inner valve is constructed with a projecting portion of the base, #15, which acts as a secondary inner valve seat, and which counter sinks the inner valve guide, #14, when installed into the hollow portion of the outer valve stem, #31. When the inner valve is displaced open an air pot is exposed, #24, which can by trapping and compressing atmosphere effectively dampen inner valve closing. This in turn can effectively retard independent inner valve deflection and bounce in direct proportion to engine speed.

As depicted in FIG. 5 an alternative embodiment could employ an air pot dampening and/or control means to effectively dampen and/or control the closing, #24, and the opening, #18, of an inner disc type valve, eliminating the need for a control spring(s).

As depicted in FIGS. 1, 2, & 3, the outer valve remains static until a cam lobe, FIG. 2-#9, transfers its displacement to a rocker arm, FIG. 3-#10, to displace the outer valve in the direction of the open position in a predetermined timed sequence, as depicted in FIG. 3.

The aforementioned pressure differential, which is responsible for the inner valve's cumulative actuation and displacement, changes its timing in relation to crank angle throughout the R.P.M. (revolutions per minute) range. It also changes in response to throttle position. Since the inner valve actuation is independent of the outer valve actuation it automatically responds to these changes with varied timing, duration and displacement. This broadens the torque and useful output range as well as improves the throttle response of a typical internal combustion engine.

As depicted in FIG. 3, when both inner and outer valves are displaced open at the same time open valve area is increased, which in turn improves flow dimension, increases velocity of the air/fuel atmosphere, and increases turbulence in the combustion chamber, which creates a more homogeneous a air/fuel charge. This significantly improves the performance, fuel efficiency, and emission quality of a typical internal combustion engine.

I claim:

1. A poppet valve comprising:

a) an outer valve member having a valve stem, a valve base, and an intermediate fillet connecting said valve stem and valve base, with at least one vent opening through the base and/or fillet for communicating a direct passage between a cylinder and its respective intake port, said valve stem being configured with a hollow interior, open through its valve base mounting end, and closed on its valve stem tip end, b) an inner valve guide bearing member fitted and affixed into and within said hollow interior of the outer valve stem to effectively constrict mass flow into or through said hollow interior, and configured to operatively retain, support, and guide an inner valve member's engagement with said outer valve member, and c) an inner valve member configured for operative engagement with said inner valve guide bearing member to open and close the vent opening through the outer valve base configured to releasably seal the vent opening through the base of said outer valve member.

2. The valve mechanism of claim 1 wherein said inner valve guide bearing member comprises a sleeve member installed in said hollow interior portion of the outer valve stem and the inner valve member includes a valve stem configured for operative sliding reception with said sleeve member, said sleeve member and said valve stem including cooperating, interengaging retainer means for limiting axial movement of the valve stem within the sleeve member and for securing the valve stem and sleeve member against inadvertent separation.

3. The valve mechanism of claim 2 including control spring means interengaging said sleeve member and said inner valve stem for providing a predetermined load rate between the inner valve member and the sleeve member for controlling the actuation speed, duration and displacement of the inner valve member.

4. The valve mechanism of claim 1 wherein said hollow interior portion of the outer valve stem comprises an axial bore and said inner valve guide bearing member comprises an elongated retainer pin member configured for fixed mounting in said axial bore and said inner valve member comprises a valve base disc member configured for sliding reception and mounting on said retainer pin member for axial movement of the valve base disc member thereon between positions in which the valve base member selectively seals and opens said vent openings through the base of the outer valve member.

5. The valve mechanism of claim 1 including an air pot dampening means to effectively control and dampen the seat mating action of the inner valve means.

6. The valve mechanism of claim 1 wherein the inner valve is formed of a titanium alloy material.

* * * * *